US006182549B1

(12) United States Patent
Albright et al.

(10) Patent No.: US 6,182,549 B1
(45) Date of Patent: Feb. 6, 2001

(54) APPARATUS FOR SECURING FLAT ARTICLES FOR CUTTING

(76) Inventors: Alto Albright, 818 16th Ave. W., Kirkland, WA (US) 98033; Sam Albright, 607W. 3rd Ave., Ellensburg, WA (US) 98926

( * ) Notice: Under 35 U.S.C. 154(b), the term of this patent shall be extended for 0 days.

(21) Appl. No.: 09/231,933

(22) Filed: Jan. 14, 1999

Related U.S. Application Data

(63) Continuation-in-part of application No. 09/018,324, filed on Feb. 3, 1998, now abandoned.

(51) Int. Cl.[7] ..... B26D 7/02

(52) U.S. Cl. ..... 83/454; 83/455; 83/581; 30/393; 33/437; 269/303; 269/313

(58) Field of Search ..... 83/454, 455, 581, 83/614; 30/293, 294; 33/430, 437; 269/303, 319

(56) References Cited

U.S. PATENT DOCUMENTS

| | | | | |
|---|---|---|---|---|
| D. 304,808 | * | 11/1989 | Carithers, Jr. | D10/65 |
| 2,187,574 | | 1/1940 | Nigra . | |
| 2,327,223 | | 8/1943 | Silver . | |
| 2,790,498 | | 4/1957 | Carscallen . | |
| 3,077,805 | | 2/1963 | Stanley . | |
| 4,030,192 | | 6/1977 | Umholtz | 30/310 |
| 4,038,751 | | 8/1977 | Albright | 30/293 |
| 4,102,050 | | 7/1978 | Roth | 33/76 R |
| 4,158,977 | | 6/1979 | Logan | 83/522 |
| 4,176,452 | | 12/1979 | Duggins et al. | 30/293 |
| 4,233,736 | | 11/1980 | Duggins et al. | 30/293 |
| 4,262,419 | | 4/1981 | Pierce | 30/293 |
| 4,339,877 | | 7/1982 | Pierce | 30/293 |
| 4,382,616 | | 5/1983 | Olivieri | 280/825 |
| 4,413,542 | * | 11/1983 | Rempel | 83/455 |
| 4,449,304 | * | 5/1984 | Underwood | 33/430 X |
| 4,470,201 | | 9/1984 | Lindquist | 33/430 |

(List continued on next page.)

FOREIGN PATENT DOCUMENTS 671486 5/1952 (GB) .

*Primary Examiner*—M. Rachuba
(74) *Attorney, Agent, or Firm*—Seed IP Law Group PLLC

(57) ABSTRACT

Apparatus for securing flat articles to be cut, includes, in one embodiment, a base and a clamp bar coupled to the base by actuators. The actuators are slideably moveable to actuate the clamp bar between a clamping position near the base and an open position away from the base. A flat article is positioned between the clamp bar and the base, and the actuators are moved to position the clamp bar into the clamping position, securing the flat article to the base in a desired position for cutting. In an alternate embodiment, an apparatus includes a biasing member operatively engaged with the clamp bar to urge the clamp bar away from or toward the base. In another alternate embodiment, an apparatus includes a swing arm slideably coupled with the clamp bar, the swing arm having a straight edge. The swing arm projects away from the clamp bar and is slideably moveable across the base, thereby facilitating the securing of the flat and providing the straight edge for guiding a cutting device along a desired axis of cutting. In another embodiment, the swing arm includes pinch clamps that pinch and slideably engage the clamp bar, eliminating the need for maintaining precision tolerances between the clamp bar and the swing arm. In yet another alternate embodiment, the swing arm includes an angular adjustment assembly. In yet another alternate embodiment, an apparatus includes a cutting bar adjustably attached to the clamp bar. In yet another alternate embodiment, an apparatus includes a second clamp bar coupled to the base by second actuators, thereby allowing a flat article to be secured along two axes for cutting. In still another alternate embodiment, an apparatus includes a base having at least one channel disposed therein, a rail member engageable within the channel, a clamp bar, actuators and a swing arm. The swing arm is slideably coupleable with the clamp bar or with the rail.

22 Claims, 14 Drawing Sheets

U.S. PATENT DOCUMENTS

| | | | | |
|---|---|---|---|---|
| 4,577,415 | * | 3/1986 | Schiller | 33/430 |
| 4,611,406 | * | 9/1986 | Engstrom et al. | 33/430 X |
| 4,685,366 | * | 8/1987 | Beder | 83/455 |
| 4,779,346 | | 10/1988 | Schafer | 33/1 B |
| 4,866,847 | | 9/1989 | Batrack et al. | 30/293 |
| 4,867,023 | | 9/1989 | Kozyrski et al. | 83/455 |
| 4,871,156 | * | 10/1989 | Kozyrski et al. | 83/455 X |
| 4,875,667 | | 10/1989 | Schafer | 269/91 |
| 5,271,305 | * | 12/1993 | Peters et al. | 83/455 |
| 5,845,409 | * | 12/1998 | Kimoto | 33/430 X |

* cited by examiner

APPARATUS FOR SECURING FLAT ARTICLES FOR CUTTING

CROSS-REFERENCE TO RELATED APPLICATION

This application is a continuation-in-part of U.S. patent application Ser. No. 09/018,324, filed Feb. 3, 1998; now abandoned.

TECHNICAL FIELD

The present invention relates to apparatus for securing flat articles for cutting, in particular for cutting mat used in framing applications or fabric used in sewing applications such as quilting.

BACKGROUND OF THE INVENTION

A variety of applications require precise cutting of flat articles; two such applications are framing and quilting. In framing applications, flat mats are used to suspend articles such as pictures, drawings, and photographs within the frame, as well as to provide an aesthetically pleasing border between the item being framed and the frame itself In most applications, the mid-section of the mat is cut out to form an opening having an outline corresponding to, but slightly smaller than, the periphery of the object to be mounted. In other applications in which the picture is cropped, the opening has an outline substantially smaller than the periphery of the picture, and can also have a shape varying from the periphery of the picture. The edges of the opening in the mat are preferably beveled to provide a more pleasing transition between the article being framed and the mat. As shown in U.S. Pat. No. 4,038,751, devices currently exist for accurately cutting framing mat, but these devices usually require abutting an edge of the mat against an alignment guide and then making a cut parallel to the alignment guide. In the absence of supporting hardware, these devices are usually limited to making apertures in the mat in which the edges of the aperture are parallel to the edges of the mat. Also, these devices are limited to cutting framing mat because the item being cut must be rigid enough that its edge can be abutted against the alignment guide of the cutter, meaning that non-rigid articles, such as fabric, cannot be cut using this type of device.

Quilting involves sewing together many pieces of fabric to form one big item or sewing many small pieces of fabric onto a larger piece to form a specific pattern thereon. The fabric pieces are usually strips or blocks cut to a particular shape and size. Because a large number of fabric pieces go into a quilt, each piece must be cut accurately; otherwise, errors in the size of the fabric pieces will accumulate as they are sewn together resulting in a finished article that may not have the correct shape, size, or pattern. In addition, inaccurately cut fabric pieces result in a needless waste of fabric. Blocks and strips of fabric for quilting are currently cut by placing the fabric upon a flexible pad, manually holding a straightedge upon the fabric along a line to be cut, and drawing a cutter along the straightedge. This method does not provide high accuracy cuts, because it is difficult to get a precise alignment manually, and because the straightedge can easily slip from the user's hand during cutting. This method is unsuitable for cutting framing mat because of the difficulty in obtaining a precise alignment, and the difficulty in holding a blade at the precise bevel angle necessary while running it along the straightedge.

Some devices exist that are capable of cutting a variety of flat articles, including both framing mat and fabric.

Examples are U.S. Pat. No. 4,685,366 and U.S. Pat. No. 4,470,201. One device, shown in U.S. Pat. No. 4,685,366, employs a straight bar that functions as both a straightedge and a means of clamping the flat article to a base. The article is usually aligned so that the edge of the straight bar runs along the line to be cut, and securely clamped using the bar. After clamping, a cutter is run along the edge of the bar to obtain the cut in the article. Although these devices are able to cut a larger variety of items, they are not well suited for accurate cutting because the bar used to clamp and cut the item does not provide an accurate means of aligning the item; instead, the item must be placed and aligned by hand, leading to errors. Furthermore, because the same bar is used for both clamping and cutting, the bar must be unclamped and re-clamped for each separate cut; it follows that the flat item being cut must be realigned for every cut to be made on it, resulting in further errors. Finally, these devices do not provide an accurate means of cutting at an arbitrary angle; if an angled cut is desired, the article must be un-clamped, manually aligned to the desired orientation, and re-clamped. This leads to both linear and angular cutting errors.

DETAILED DESCRIPTION OF THE INVENTION

An apparatus for securing flat articles to be cut, and in particular an apparatus for cutting framing mat and fabric, is described in detail herein. In the following description, numerous specific details are set forth to provide a thorough understanding of the present invention. One skilled in the relevant art, however, will readily recognize that the present invention can be practiced without one or more of the specific details described herein.

Figure 1:
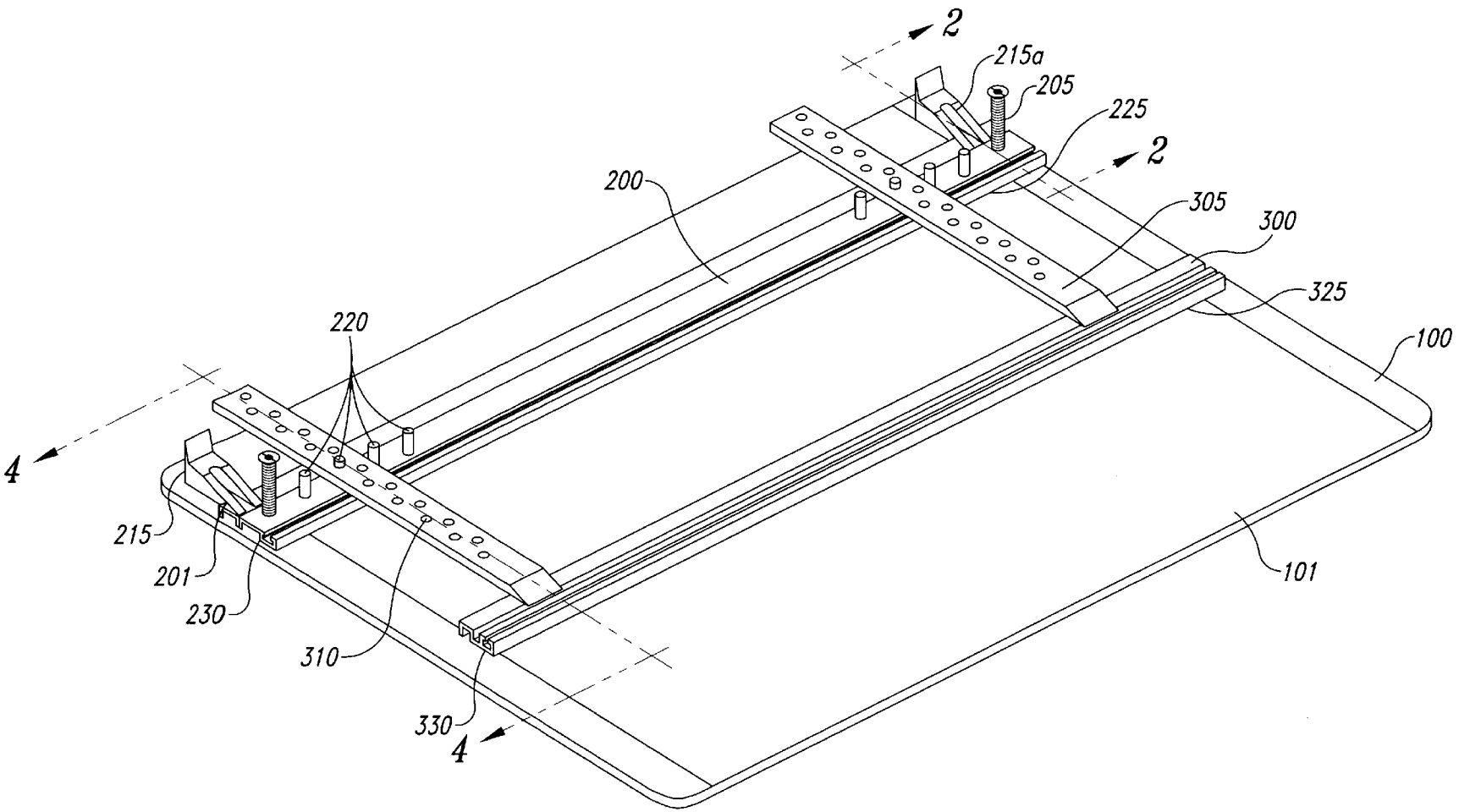
FIG. 1 is an isometric view of an apparatus for securing flat articles to be cut in accordance with an embodiment of the invention.

FIG. 1 shows a first embodiment having as its main components a base 100, a clamp bar 200, and a cutting bar 300. In the description that follows, features are labeled according to which of the above main components they are most closely associated with. For example, features associated with the clamp bar 200 will be labeled with numbers between 201 and 299.

The base 100 is a flat rectangular board having thereon a removable and replaceable pad 101. The pad 101 provides backing for the cutter blade so it can better cut the flat article, prevents the base 100 from being damaged by the cutter blade, and has lines printed thereon at a variety of angles to assist in aligning the flat article.

Figure 2A:
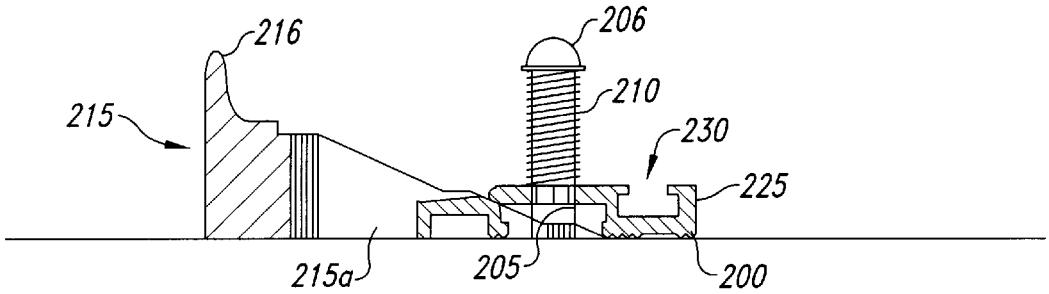
FIG. 2*a* is a partial cross sectional of the apparatus of FIG. 1 taken along line 2—2 with a clamp bar in a clamping position.
Figure 2B:
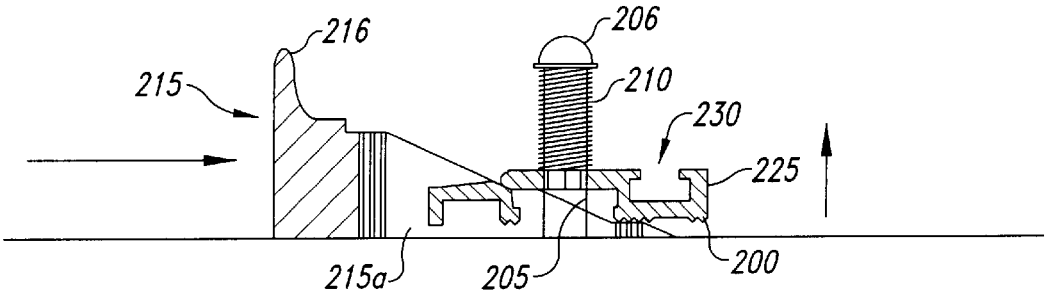
FIG. 2*b* is a partial cross sectional view of the apparatus of FIG. 1 taken along line 2—2 with the clamp bar in a partially raised position.
Figure 2C:
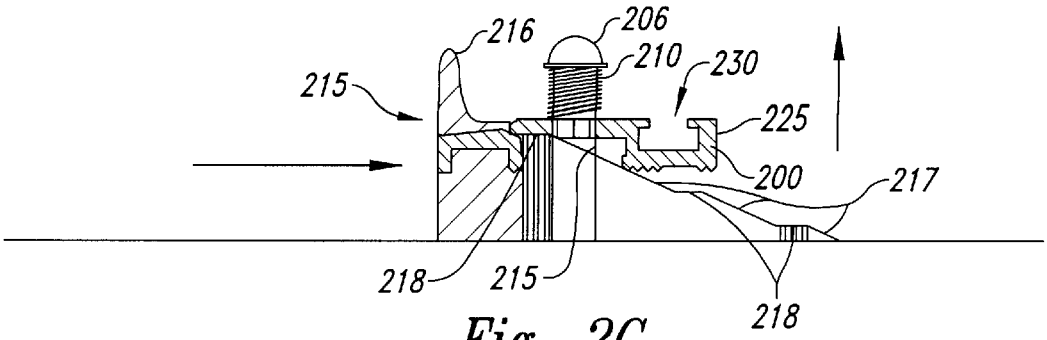
FIG. 2*c* is a partial cross sectional view of the apparatus of FIG. 1 taken along line 2—2 with the clamp bar in a fully raised position.

The clamp bar 200 is retained on the base 100 by guide pins 205 that are secured to the base and along which the clamp bar 200 is vertically movable with respect to the base 100. The clamp bar 200 is offset from the edge of the base 100, making it easier to feed fabric or other non-rigid articles underneath the clamp bar. Rubber strips or pads (not shown) can be attached to the bottom of the clamp bar and/or on the base (under the clamp bar) to help secure the clamped article. As shown in FIGS. 2*a* through 2*c*, the clamp bar 200 is biased downwardly towards the base 100 by springs 210 carried on the guide pins 205, between a head 206 of the guide pins 205 and an upper side of the clamp bar 200. Vertical movement of the clamp bar 200 against the biasing force of the springs 210 is accomplished using a pair of wedge-shaped lifters 215 slidably interposed between the base 100 and the clamp bar 200 and retained on the base 100 by the guide pins 205 extending through an elongated slot 215*a* formed in the lifters. The wedge-shaped lifters 215 are prevented from rotating about the guide pins 205 by guide slots 201 formed in the clamp bar 200. In another alternative embodiment, the wedge-shaped lifters 215 are replaced with cam type lifters.

On top of the clamp bar 200 are mounted two sets of alignment stops 220, one set in proximity with each end of the clamp bar. The cutting bar 300 is shown in a typical operating position removably connected to the clamp bar 200 by two arms 305 having therein slots or holes 310 that removably engage the alignment stops 220. Each hole 310 in each arm 305 has a corresponding hole in the other arm; likewise, each alignment stop 220 in each set of stops has a corresponding stop in the other set. Corresponding holes in each arm engage corresponding alignment stops in each set.

FIGS. 2*a* through 2*c* show details of the clamp bar 200 and how the lifters 215 vertically move or translate the clamp bar against the biasing force of the springs 210. As shown in FIG. 2*a* the clamp bar 200 has a straight alignment edge 225 which, when the clamp bar 200 contacts the base 100, can be used for rapid alignment of substantially rigid flat articles by abutting an edge of the article against the alignment edge. Further, the clamp bar 200 has therein a channel 230 in which a variety of tools (not shown) may be slidably engaged.

The lifters 215 have a handle 216 by which the user holds and slides the lifters toward the guide pins 205 to lift the clamp bar (FIG. 2*b*). Each lifter 215 has a series of sloping surfaces 217, with a series of plateaus 218 therebetween that hold the clamp bar 200 at discrete heights above the base 100. The biasing force of the springs 210 is chosen to be strong enough to securely clamp the article, yet weak enough that excessive force is not needed to slide the lifters. FIG. 2*a* shows the lifter 215 slid to its outermost position, putting the clamp bar 200 in its operating position clamping a flat article (not shown) against the base 100. FIG. 2*b* shows the lifter 215 slid to an intermediate position in which the clamp bar 200 has moved up the first sloped surface 217 and is resting on the first plateau 218 at a small distance above the base 100. FIG. 2*c* shows the lifter 215 slid to its innermost position where the clamp bar 200 has slid up all the sloped surfaces 217 and rests on the highest plateau 218 at the highest position above the base 100. Although the lifters 215 in this embodiment are shown as being wedge shaped, the lifters 215 may have a variety of alternate shapes that function to raise the clamp bar 200 when the lifters 215 slide toward the guide pins 205, and to lower the clamp bar 200 when the lifters 215 are withdrawn.

Figure 3:
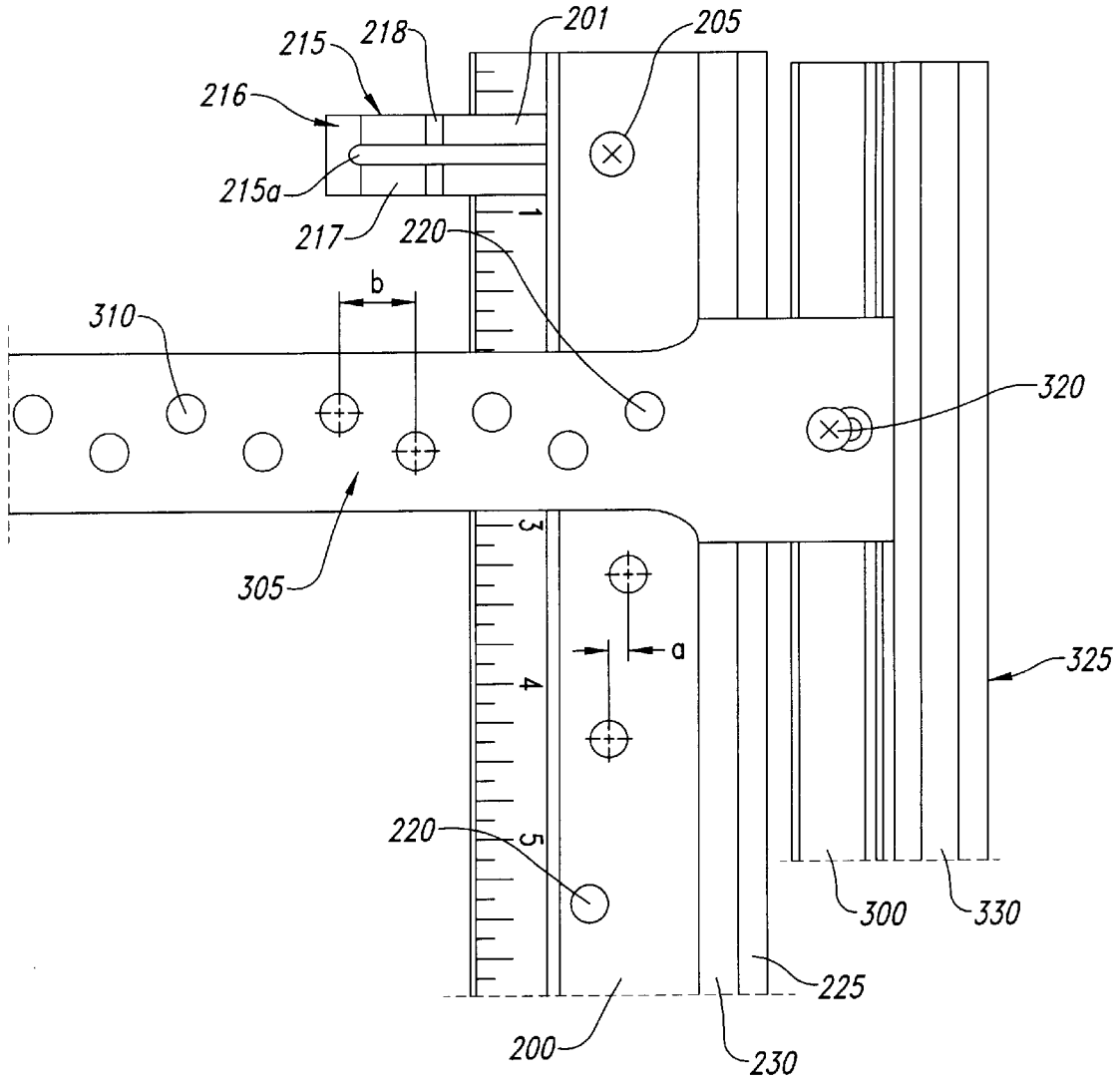
FIG. 3 is an enlarged partial top elevational view of the apparatus of FIG. 1.

FIG. 3 best shows details of the cutting bar 300 and its engaging relationship with the clamp bar 200. The alignment stops 220 are spaced in a direction normal to a longitudinal axis of the clamp bar 200 at small equal increments a, typically ⅛th of an inch, and are spaced along the longitudinal axis of the clamp bar 200 in such a way that the distance between corresponding members of each set of alignment stops is equal to the distance between corresponding holes 310 on the arms 305.

The holes 310 are spaced at equal increments b in a direction parallel to the centerline of the arm 305, usually at a larger increment than the spacing of the alignment stops 220, to permit more coarse positioning of the cutting bar 300 (e.g., ½ of an inch). Successive holes 310 are on alternating sides of the centerlines of the arms 305 to ensure that the user will always properly engage corresponding holes on both arms, thus keeping the cutting bar 300 parallel to the clamp bar 200. The cutting bar 300 is mounted to the arms 305 via a fastener 320 in a slot 315 within which the cutting arm 300 may be adjusted between two positions in which the cutting bar 300 remains parallel to the clamp bar 200.

Figure 4A:
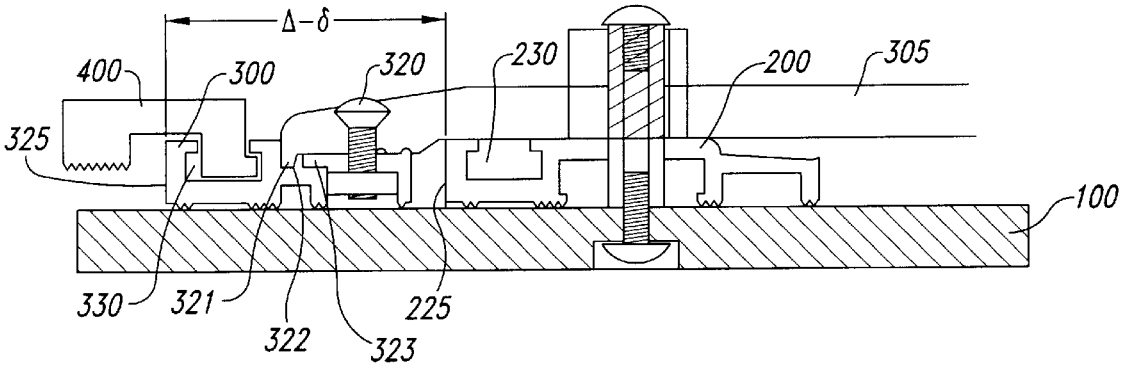
FIG. 4*a* is a partial cross sectional view of the apparatus of FIG. 1 taken along line 4—4 with a cutting bar in a first position.
Figure 4B:
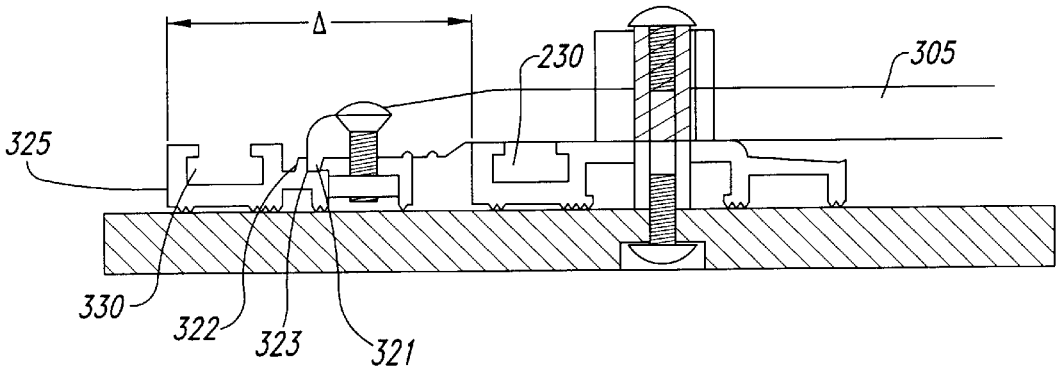
FIG. 4*b* is a partial cross sectional view of the apparatus of FIG. 1 taken along line 4—4 with the cutting bar in a second position.

FIGS. 4*a* and 4*b* illustrate features of the cutting bar and the adjustability of the cutting bar 300 relative to the arms 305. The cutting bar 300 has therein a longitudinally extending channel 330 that is identical to the channel 230 in the clamp bar 200 and is similarly capable of slidably receiving a variety of tools. The cutting bar 300 also has an operating edge 325 along which the cutter—whether it be a mat cutter, fabric cutter, or other cutter—is drawn to cut the flat article. The operating edge 325 is kept parallel to the alignment edge 225 by the operation of the engaging holes 310 with the alignment stops 220. FIG. 4*a* best illustrates the first position of the cutting bar 300 relative to the arm 305, this position being used for cutting framing mat. The second position of the cutting bar 300 relative to the arm 305 is best shown in FIG. 4*b,* this position being used for cutting fabric. To adjust the cutting bar between the mat and fabric positions, the fastener 320 is loosened until an alignment ridge 321 formed in the arm 305 can be lifted out of a mat aligning channel 322 formed in the cutting bar 300. The alignment ridge 321 is removed from the mat aligning channel 322 and the cutting bar 300 is moved away from the clamp bar 200 until the alignment ridge 321 coincides with a fabric aligning channel 323. The ridge 321 is placed into the fabric aligning channel 323 and the fastener 320 is tightened to secure the cutting bar in its new position.

Figure 5:
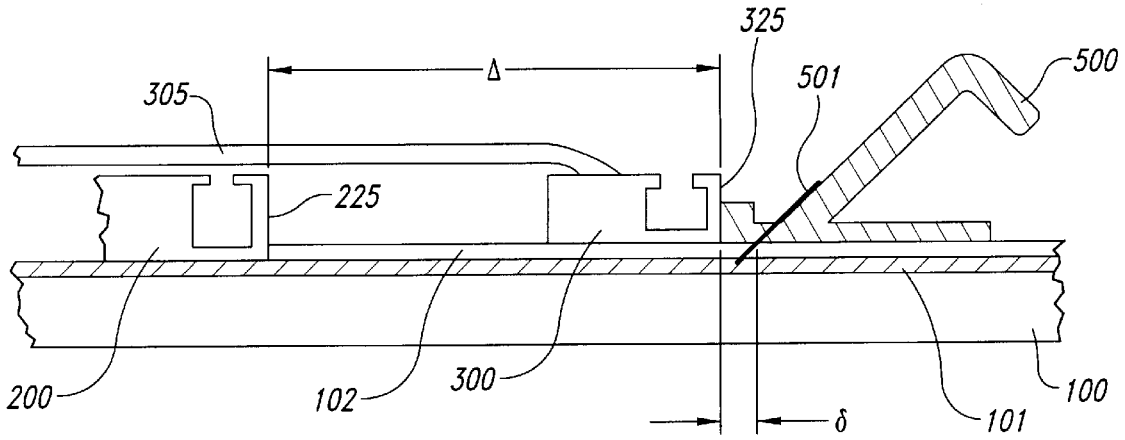
FIG. 5 is a partial cross-sectional view of an embodiment of a bevel cutter abutted against the cutting bar of FIG. 1.

Adjustability of the cutting bar 300 is necessary to compensate for the offset created by the bevel cutters used for cutting framing mat, as shown in FIG. 5. Fabric cutting applications do not use a beveled cut, so that the position along which the cut is made corresponds exactly to the position of the operating edge and there is no offset. But in a typical bevel cutter 500, a cutting blade 501 is angled to create the bevel in a mat 102, meaning that the blade intersects the mat at a different lateral position than the operating edge 325, the lateral distance between the two being the distance $\delta$. Thus, if the alignment stops and engaging elements were used to place the operating edge 325 at a distance $\Delta$ from the alignment edge 225, the blade 501 would cut the mat a distance $\Delta+\delta$ from the alignment edge. To make the apparatus usable for both mat and fabric, the cutting bar must be laterally adjustable by the distance $\delta$. Thus, in the mat position shown in FIG. 4*a,* the operating edge 325 is at a lateral distance $\Delta-\delta$ from the alignment edge 225, placing the blade 501 at a distance $\Delta-\delta+\delta=\Delta$ from the alignment edge 325. In the fabric position shown in FIG. 4*b,* the operating edge 325 is at distance $\Delta$ from the alignment edge 225, since there is no offset in the fabric cutter.

In operation, the flat article must first be aligned and held. This step will vary depending of the nature of the flat article and the type of cut to be made: if the flat article is substantially rigid and the desired cut in the article is parallel to an existing edge of the article, the clamp bar 200 is kept in its lowered position against the base 100 and the flat article is placed on the base 100, abutted against the alignment edge 225, and held in that position by the user; if the flat article is not rigid, or if a cut is desired that is not parallel to an existing edge of the article, the lifters 215 are slid to their innermost position (FIG. 2*c*), raising the clamp bar 200 to its uppermost position relative to the base 100. The flat article is placed between the base 100 and the clamp bar 200 in the desired orientation and the lifters 215 are pulled by the user to their outermost position (FIG. 2*a*) to lower the clamp bar 200 onto the article and hold it securely.

When the article has been aligned—and clamped if necessary—the cutting bar 300 is adjusted relative to the arms 305 to the correct position for mat or fabric (FIGS. 4*a* and 4*b*). Once properly adjusted, the cutting bar 300 is placed in its desired position by engaging the proper holes 310 with the proper alignment stops 220 such that the cutting bar 300 is at the desired distance from the clamp bar 200. With the cutting bar 300 in place, the user cuts the article by placing a cutter suitable to their application in sliding engagement with the operating edge 325 and drawing it along the edge to produce the desired cut.

Figure 6:
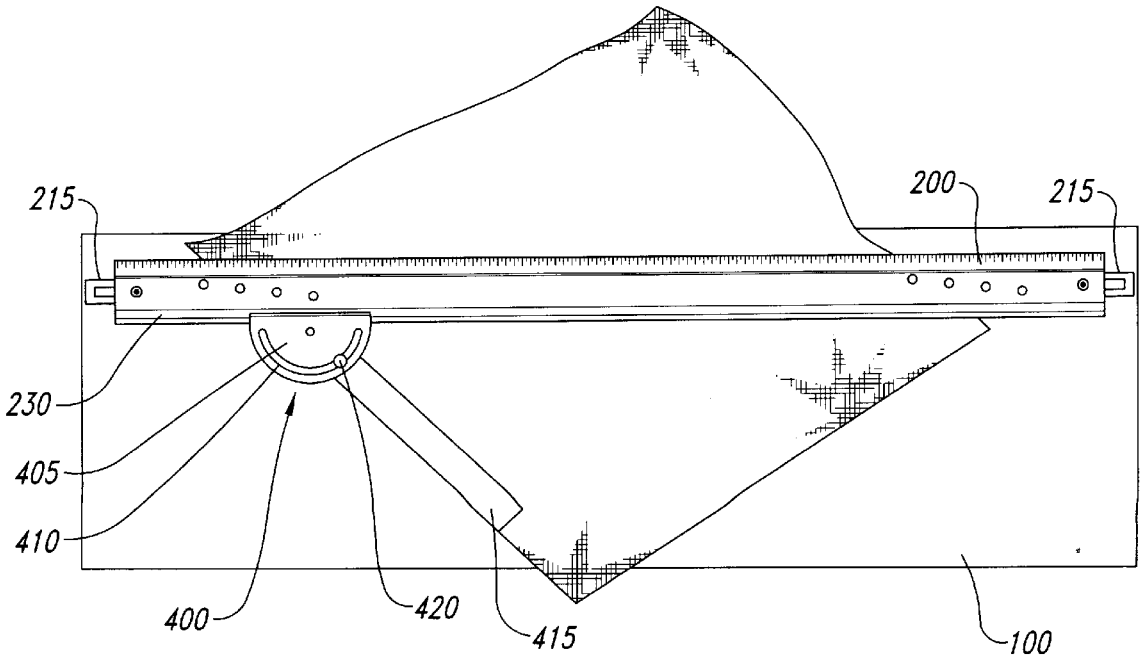
FIG. 6 is a top elevational view of an alternate embodiment of an apparatus for securing flat articles to be cut having an angular positioning device attached to a clamp bar.

FIG. 6 illustrates a second embodiment. In this embodiment, the clamp bar 200 is retained on and biased toward the base 100 in the manner previously described, and is moved relative to the base 100 by lifters 215 which, in this embodiment, slide parallel to a longitudinal axis of the clamp bar 200 rather than normal to the axis. An angular positioning device 400 is slidably engaged in the channel 230 of the clamp bar 200. The angular positioning device 400 may be secured in the desired position along the clamp bar 200 using a cam clamp (not shown) of the type known in the art. The angular positioning device has a semi-circular body 405 having a series of index markings thereon (similar to a protractor) and a slot 410 that follows the circular contour of the body. A straightedge 415 is pivotally attached to the semi-circular body 405 and has a locking knob 420 attached thereto and having a threaded portion (not shown) extending through the slot 410, the locking knob 420 being used to secure the straightedge 415 to the semi-circular body 405 once its angular position has been selected. This embodiment is particularly useful in applications where the article must be cut at an angle. For example, in fabric cutting it is customary to cut the fabric along the bias, usually at an angle of 45° or 60° relative to the weft or warp of the fabric.

In operation, the article is aligned and secured in one of the ways described above in connection with the first embodiment. Once the article is aligned and secured, the angular positioning device 400 is placed in the channel 230 of the clamp bar 200 and moved along the clamp bar to the desired position, where it is locked using the cam clamp. The straightedge 415 is swung about the slot 410, set to a desired angle, and locked in that position using the locking knob 420. A cutter suitable for the application is placed in sliding engagement with an outer edge of the straightedge 415 and drawn along the length of the edge to produce the desired cut. Alternatively, the edge of the straightedge 415 can be used as a means of aligning an edge of the article and, once the article is aligned and clamped, the cutter can be drawn along the alignment edge 225 to produce the desired cut.

In a third embodiment, the angular positioning device 400 is mounted in the channel 330 on the cutting bar 300 instead of the channel 220 on the clamp bar 200, as shown in broken lines in FIG. 4*a*. This is possible because the channel 330 is of identical size and shape as the channel 230. In this configuration, both the width and angle of the cut on the flat article may be adjusted to various combinations depending upon the placement of the alignment holes 310 in the alignment stops 220 and the settings of the straightedge 415 relative to the semi-circular body 405.

The operation of the third embodiment is similar to the operation of the second embodiment as described above. Having aligned and secured the flat article using the clamp bar 200, the cutting bar 300 is placed at the desired distance from the clamp bar 200 by engaging the holes 310 with the desired alignment stops 220. The angular positioning device 400 is placed in the channel 330 on the cutting bar 300, moved to the desired position along the length of the cutting bar 300, and locked in that position. The straightedge 415 is adjusted to the desired angle and is locked in position using the locking knob 420. A cutter suitable for the application is placed in sliding engagement with an outer edge of the straightedge 415 and drawn along the edge to produce the desired cut in the flat article. Alternatively, the edge of the straightedge 415 can be used as a means of aligning an edge of the article and, once the article is aligned and clamped, the cutter can be drawn along the operating edge 325 to produce the desired cut.

In a fourth embodiment (not shown), the clamp bar 200 is used without the cutting bar 300 or the angular positioning device 400. In this embodiment, the clamp bar 200 aligns and secures the flat article and the alignment edge 225 is used to guide the cutter. The operation of the fourth preferred embodiment begins with aligning and securing the flat article as described above in connection with the first preferred embodiment. Having aligned and secured the article, a cutter suitable for the application is placed in sliding engagement with the alignment edge 225 of the clamp bar 200 and drawn along the alignment edge 225 to produce the desired cut.

Figure 7:
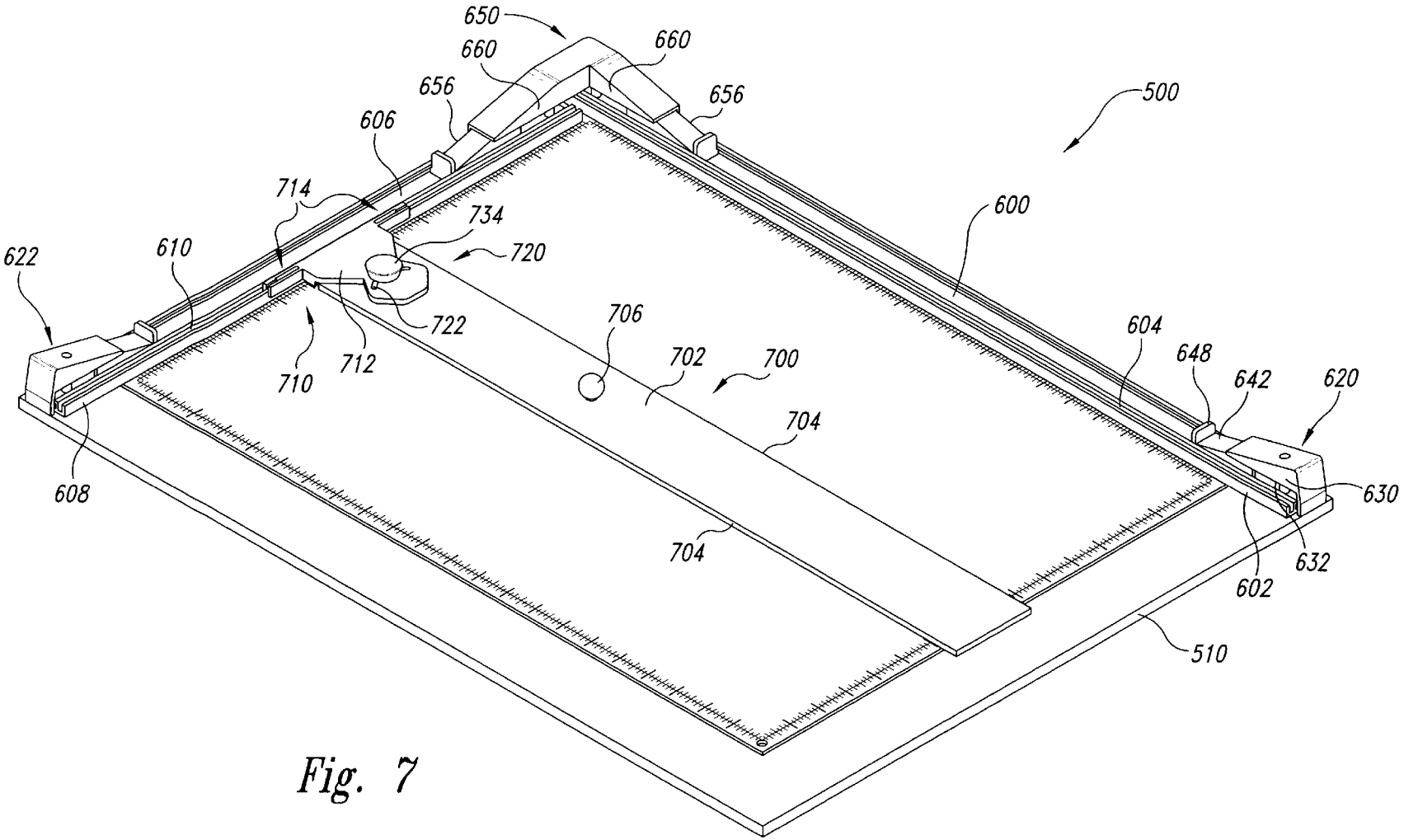
FIG. 7 is an isometric view of another alternate embodiment of an apparatus for securing flat articles to be cut.

FIG. 7 shows an isometric view of another embodiment of an apparatus for securing flat articles 500 under an aspect of the invention. In this embodiment, the apparatus 500 includes a base 510, and a first and second clamp bars 600 and 606, respectively. By using both the first and second clamp bars 600 and 606, the apparatus 500 secures a workpiece to the base 510 along two axes.

As shown in FIG. 7, the first and second clamp bars 600 and 606 have first and second abutting surfaces 602 and 608, and first and second channels 604 and 606, respectively. The first and second abutting surfaces 602 and 608 are straight surfaces and are positioned orthogonally on the base 510 to facilitate proper positioning, measurement, and cutting of a flat article. The first and second clamp bars 600 and 606 are coupled to the base 510 by first and second actuators 620 and 622, respectively, and by a corner actuator 650.

Figure 8:
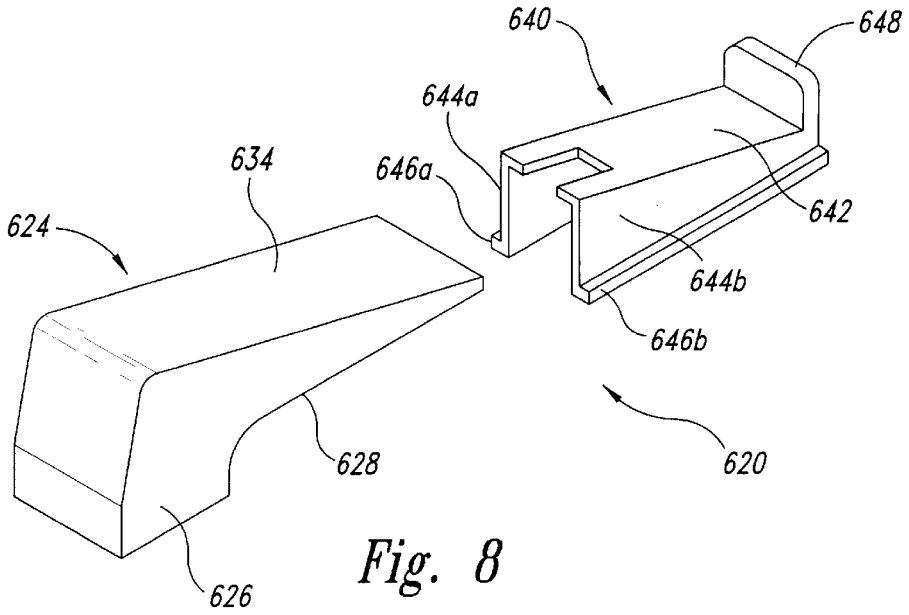
FIG. 8 is an exploded isometric view of an actuator of FIG. 7.
Figure 9A:
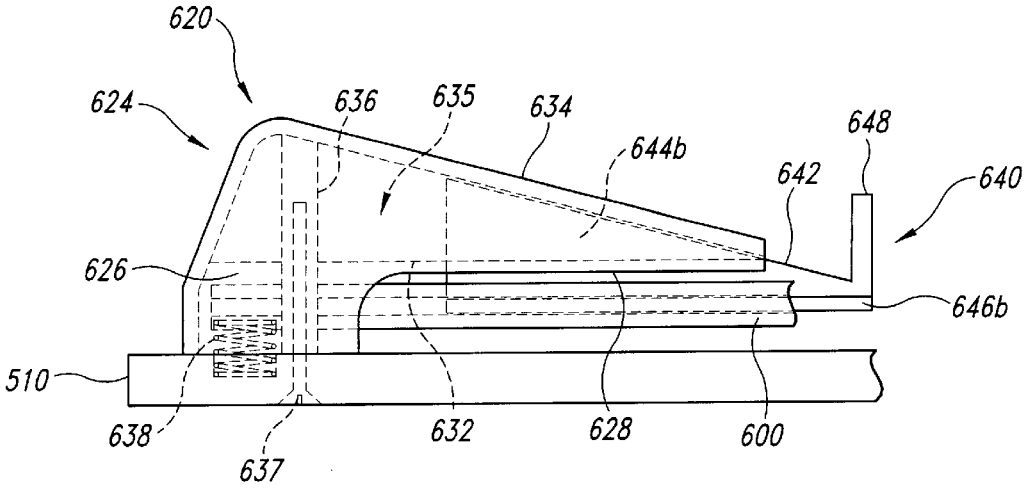
FIG. 9*a* is a side elevation view of the actuator of FIG. 7 with a clamp bar in an open position.

FIG. 8 is an exploded isometric view of the first actuator 620 shown in FIG. 7. The first actuator 620 includes a housing 624 and a slider 640. As best seen in FIGS. 8–10, the housing 624 has an outer side wall 626 with a raised edge portion 628 spaced apart from the base 510 along a portion of the outer side wall 626, and an inner side wall 630 with a bottom edge 632 spaced apart from the base 510 along its entire length (see FIG. 7). The raised edge portion 628 and raised bottom edge 632 provide clearance for the movement of the clamp bar 600, and allow the flat article being cut to be positioned under the clamp bar 600 from either side of the clamp bar 600 without interference from the inner and outer side walls 630 and 626.

A top wall 634 extends between the outer and inner sidewalls 626 and 630 to form a receiving chamber 635 therebetween. The housing 624 further includes a threaded support post 636 which passes through a hole (not shown) in the first clamp bar 600 and engages a screw 637, securing the housing 624 to the base 510. A coil spring 638 is engaged between the first clamp bar 600 and the base 510, and a web member 639 stiffens and supports the support post 636.

The slider 640 has a top surface 642 and a pair of lateral walls 644*a* and 644*b* that have runners 646*a* and 646*b*, respectively, along the bottom edges thereof. The slider 640 further includes a handle 648. The second actuator 622 of FIG. 7 has substantially the same structure as, but is a mirror image of, the first actuator 620.

During assembly, the slider 640 is positioned within the receiving chamber 635 in the housing 624. The lateral walls 644*a* and 644*b* of the slider 640 slideably fit between the inner and outer side walls 626 and 630 of the housing 624. In this position, the top surface 642 of the slider 640 slideably engages the top wall 634 of the housing 624. The support post 636 is slipped through the hole in the first clamp bar 600 so that the runners 646*a* and 646*b* slideably contact the first clamp bar 600. The coil spring 638 is positioned beside the support post 636, and the support post 636 is secured to the base 510 with the screw 637. The coil spring 638 is compressed between the base 510 and the first clamp bar 600, thereby exerting a biasing force on the first clamp bar 600 to push the first clamp bar 600 away from the base 510.

Figure 11:
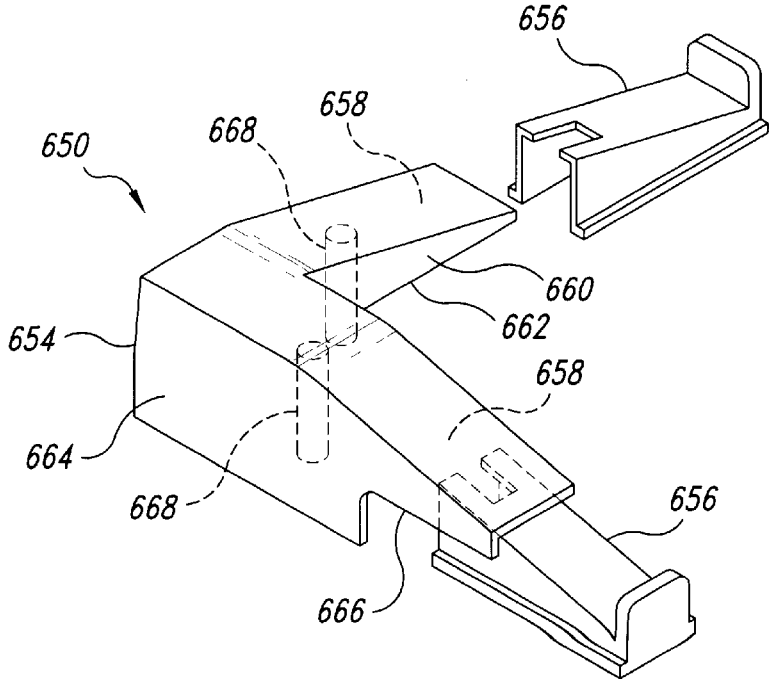
FIG. 11 is a partially exploded isometric view of a corner actuator of FIG. 7.

FIG. 11 shows a partially exploded isometric view of the corner actuator 650 of FIG. 7. The corner actuator 650 is analogous to a combination of the first and second actuators 620 and 622, and includes a corner housing 654 and a pair of corner sliders 656. The corner housing 654 includes a pair of corner receiving chambers 658 and a pair of comer inner walls 660, each having a corner lower edge 662 spaced apart from the base 510 (see FIG. 7). The comer housing 654 also includes a pair of comer outer walls 664 (only one shown), each having a raised portion 666 (only one shown). A pair of corner support posts 668 secure the corner housing 654 to the base 510.

Figure 9B:
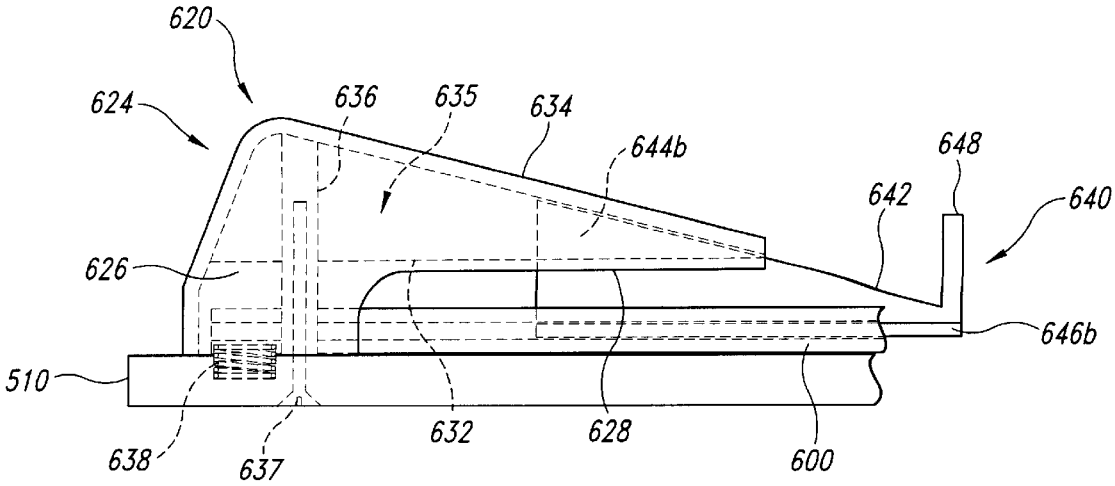
FIG. 9*b* is a side elevation view of the actuator of FIG. 7 with the clamp bar in a clamping position.
Figure 10:
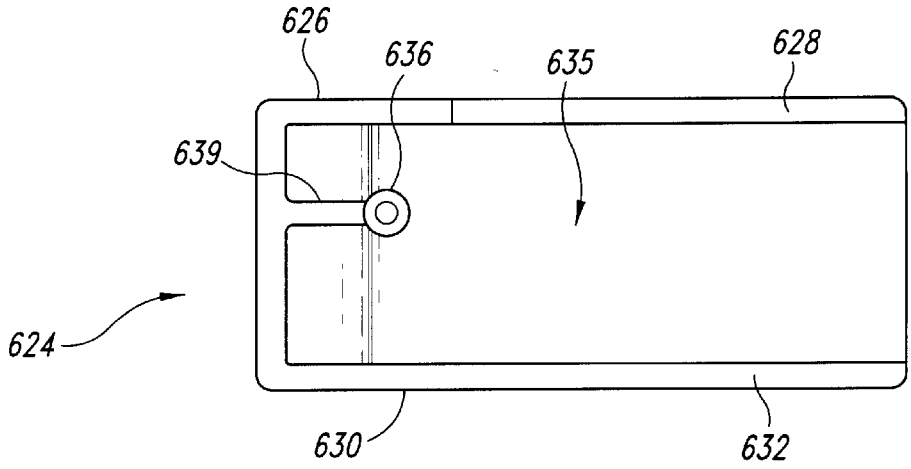
FIG. 10 is a bottom elevation view of a housing of the actuator of FIG. 7.

In operation, the first clamp bar 600 slides on the first support post 636 of the first actuator 620, and on the associated corner support post 668 of the comer actuator 650 from an open position away from the base 510 (shown in FIG. 9*a*) to a clamping position near the base 510 (shown in FIG. 9*b*). The bottom edge 632 of the inner side wall 630 of the first actuator 620 (see FIG. 7) and the corner lower edge 662 of the corner actuator 650 (see FIG. 11) are spaced apart from the base 510 to provide clearance for the movement of the first clamp bar 600 between the open and closed positions. Similarly, the second clamp bar 606 is moveable between a second open position away from the base 510 and a second clamping position near the base 510.

The first clamp bar 600 is positioned in the open position by pushing the slider 640 into the receiving chamber 635 of the first actuator 620, allowing the coil spring 638 to push the first clamp bar 600 away from the base 510. Similarly, the comer slider 656 associated with the first clamp bar 600 is pushed into the corner housing 654, allowing the corner coil spring to push the first clamp bar 600 away from the base 510. The first clamp bar 600 is thereby pushed into the open position along its entire length (FIG. 9*b*). The second clamp bar 606 is positioned in the second open position in a similar fashion.

With the first and second clamp bars 600 and 606 in their respective open positions, a rigid or non-rigid flat article (or workpiece), such as fabric, that is to be cut may be placed on the base 510 and positioned between the clamp bars 600 and 606 and the base 510. The raised edge portion 628 of the outer side wall 626 of the first and second actuators 620 and 622 and the raised portion 666 of the comer outer walls 664 of the corner actuator 650 provide clearance for the fabric to move between the base 510 and the actuators. The fabric may then be moved to the desired orientation on the base 510 and secured in position for cutting by moving the clamp bars 600 and 606 into their respective clamping positions.

To position the first clamp bar 600 in its clamping position, the slider 640 is withdrawn from the receiving chamber 635 of the first actuator 620, causing the top wall 634 of the housing 624 to push down against the top surface 642 of the slider 640. An underside of the slider 640 in turn pushes down on the first clamp bar 600 and compresses the coil spring 638. Similarly, the comer slider 656 associated with the first clamp bar 600 is withdrawn from the comer receiving chamber 658, the corner slider 656 pushing down on the first clamp bar 600 to compress the comer coil spring (not shown). The slider 640 and comer slider 656 are withdrawn from their respective receiving chambers 635 and 658 until the first clamp bar 600 firmly contacts the fabric or the base 510. The sliders are held in place through frictional contact between the sliders and their respective housings, thereby holding the first clamp bar 600 in the clamping position (FIG. 9*b*). The second clamp bar 606 is positioned in the second clamping position in a similar fashion.

The shape of the sliders is not limited to the wedge-shaped embodiment shown in FIGS. 7–10. Any slider shape that pushes the clamp bar into the clamping position when the slider is withdrawn from the receiving chamber, and allows the clamp bar to be raised into the open position when the slider is inserted into the receiving chamber, may be employed. Thus, the sliders may have a variety of shapes, including elliptic, parabolic, or other shapes that provide the desired functionality.

The above actuation devices of the invention permit more rapid clamp movement, between open and clamping positions, than actuation devices that involve threaded engagement between a moveable member and a threaded member, such as the type disclosed in U.S. Pat. No. 4,685,366 issued to Beder. Furthermore, a variety of actuator embodiments may be employed. Each actuator may include, for example, one or more biasing members (e.g. springs) to actively actuate the clamp bar into the clamping or open position. Alternately, such biasing members may be omitted to allow the clamp bar to be moved by some other means, such as by the force of gravity or by hand. The actuators may include mechanically actuated components, such as the lifters 216 (FIGS. 1–2*c*) or the sliders 640 (FIGS. 7–9*b*) described above, or may include non-mechanically actuated components, including electromagnetic, hydraulic, or pneumatically-driven components.

Figure 18:
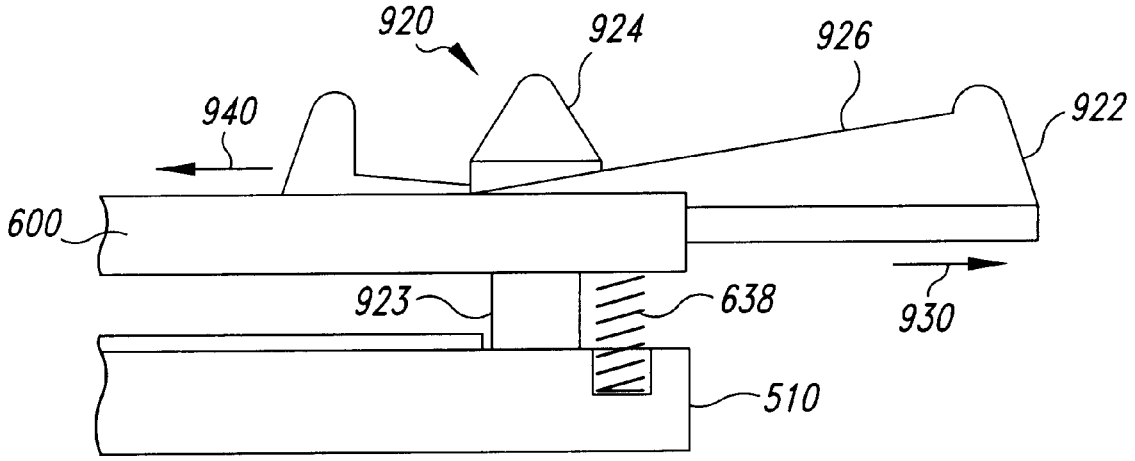
FIG. 18 is a side elevation view of an alternate embodiment of an actuator with the clamp bar in the open position.
Figure 19:
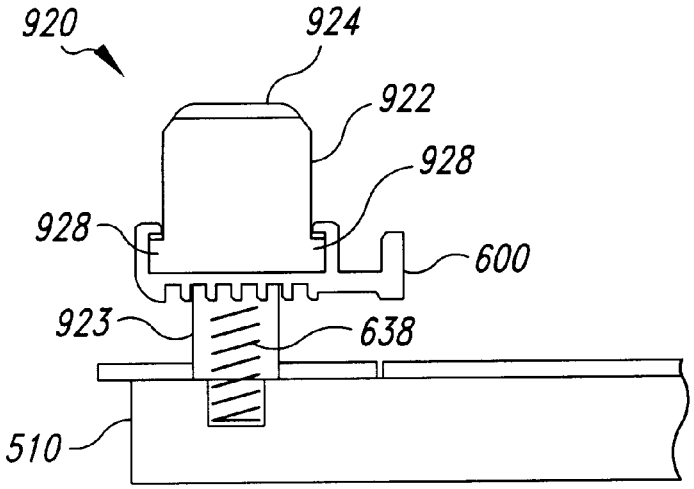
FIG. 19 is an end elevation view of the actuator of FIG. 18.
Figure 20:
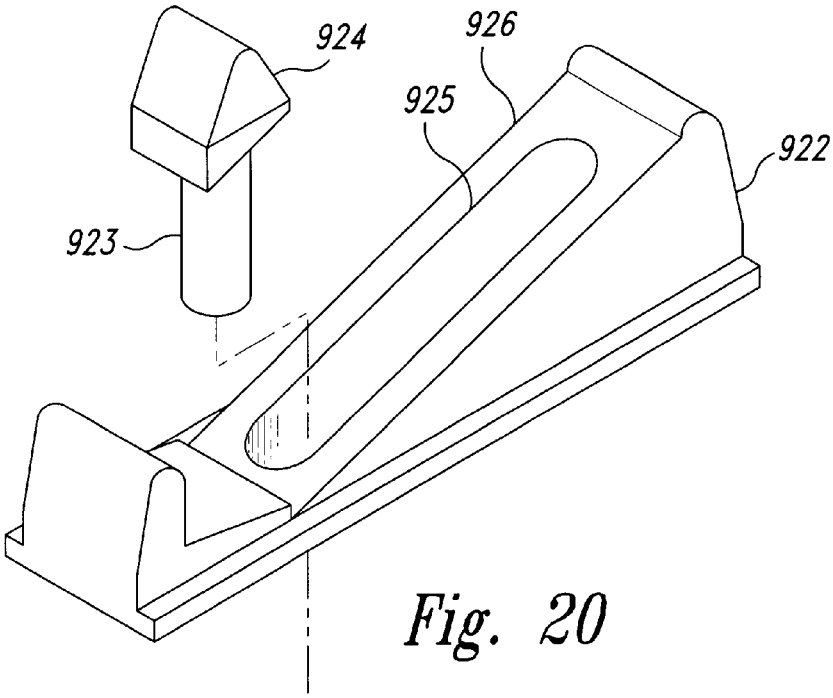
FIG. 20 is an exploded isometric view of the actuator of FIG. 18.

For example, an alternate embodiment of an actuator 920 is shown in FIGS. 18–20. In this embodiment, the actuator 920 includes a slotted-wedge slider 922 that slideably engages the first clamp bar 600, and a retaining post 923 having a retaining portion 924 that retains the slotted-wedge slider 922 to the base 510. The retaining post 923 passes through a slot 925 (FIG. 20) in an upper surface 926 of the slotted-wedge slider 922, and attaches to the base 510. As best seen in FIG. 19, the slotted-wedge slider 922 has slide rails 928 that are "captured" by the first clamp bar 600. The coil spring 638 is positioned between the base 510 and the first clamp bar 600 and operates to bias the first clamp bar 600 away from the base 510 and upwardly against the retaining portion 924.

In operation, the slotted-wedge slider 922 is moved along the clamp bar 600 in a first direction 930, causing the first clamp bar 600 to move away from the base 510 and into the open position. Conversely, as the slotted-wedge slider 922 is moved along the first clamp bar 600 in a second direction 940, the first clamp bar 600 is moved toward the base 510 and into the clamping position. The actuator 920 shown in FIGS. 18–20 advantageously eliminates the housing 624 of the actuator embodiment 620 described above, and uses the more easily fabricated retaining portion 924, thereby reducing manufacturing costs.

Figure 21:
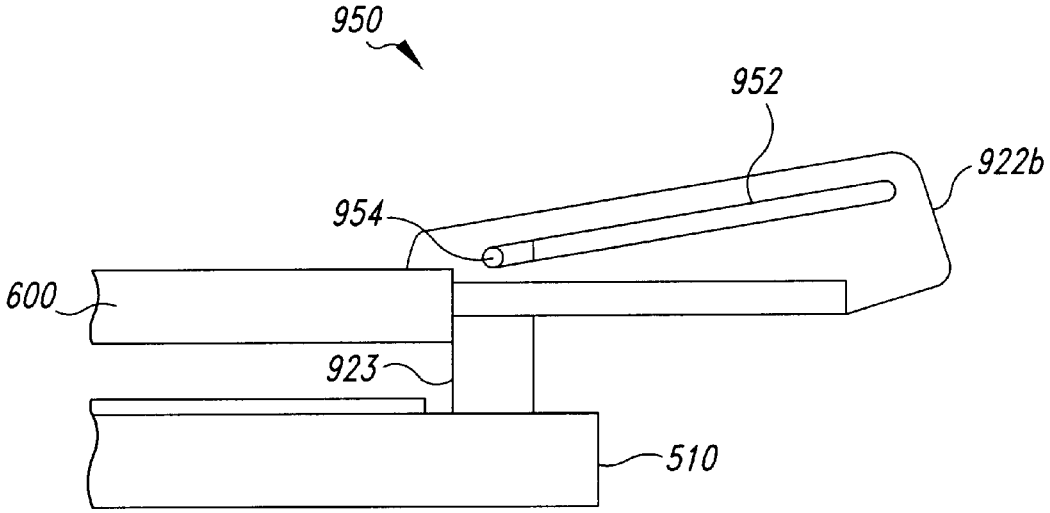
FIG. 21 is a cross-sectional view of another alternate embodiment of an actuator.

In another alternate embodiment of an actuator 950 shown in FIG. 21, the slider 922*b* includes at least one retaining slot 952 disposed therein. The retainer post 923 has a transversely projecting retaining pin 954 (end view shown) that projects into the retaining slot 952 and slideably engages therewith, and the retainer portion 924 is eliminated. As the slider 922*b* is moved in the first and second directions 930 and 940, the retaining pin 954 slides within the retaining slot 952, causing the clamp bar 600 to move between the open and clamping positions, respectively. In this way, the coil spring 638 may be eliminated. Alternate ways of engaging the slider 922*b* with the retaining post 923 (or the above-described slider 640 with the housing 624) to achieve the desired sliding engagement in order to eliminate the spring or other biasing member are possible, including for example, the addition of rails on the slider 922*b* that are "captured" by the retaining post 923 in a manner similar to the engagement between the slotted-wedge slider 922 and the first clamp bar 600 shown in FIG. 19.

Also, although the first and second clamping bars 600 and 606 are shown oriented at a right angle (i.e. orthogonal) to each other in FIG. 7, it is possible to position the clamp bars on the base at any desired angle depending on the application. It is also possible to position one or more additional clamp bars on the base to provide additional clamping and securing capability.

An advantage of the apparatus 500 having two clamping bars 600 and 606 is that a flat article may be secured along two axes for cutting, providing improved securability to prevent the article from slipping during measuring, marking, or cutting. This is especially advantageous for highly flexible articles, such as cloth articles used for quilting, sewing, or other textile applications. Because each clamp bar is independently securable from the other, one clamping bar may be positioned in its clamping position to serve as an alignment guide as the flat article is moved into position on the base, or for aligning a cutting mat or other cutting accessory on the base.

Furthermore, the actuators of the apparatus 500 allow the clamping bars to be moved between the open and clamping positions without having any sliders, lifters, or other parts extending beyond the outer edges of the base 510. This advantageously improves the operability of the apparatus 500 in a more confined or limited workspace, and reduces the potential for damage or breakage of components.

Also depicted in FIG. 7 is a swing arm 700 including a main body 702 and an end assembly 710. The main body 702 has straight edges 704 and a handle 706 to help move the swing arm 700 over the base 510. The end assembly 710 includes a chassis 712 having a pair of pinch clamps 714 that slideably engage the second clamp bar 606.

Figure 12:
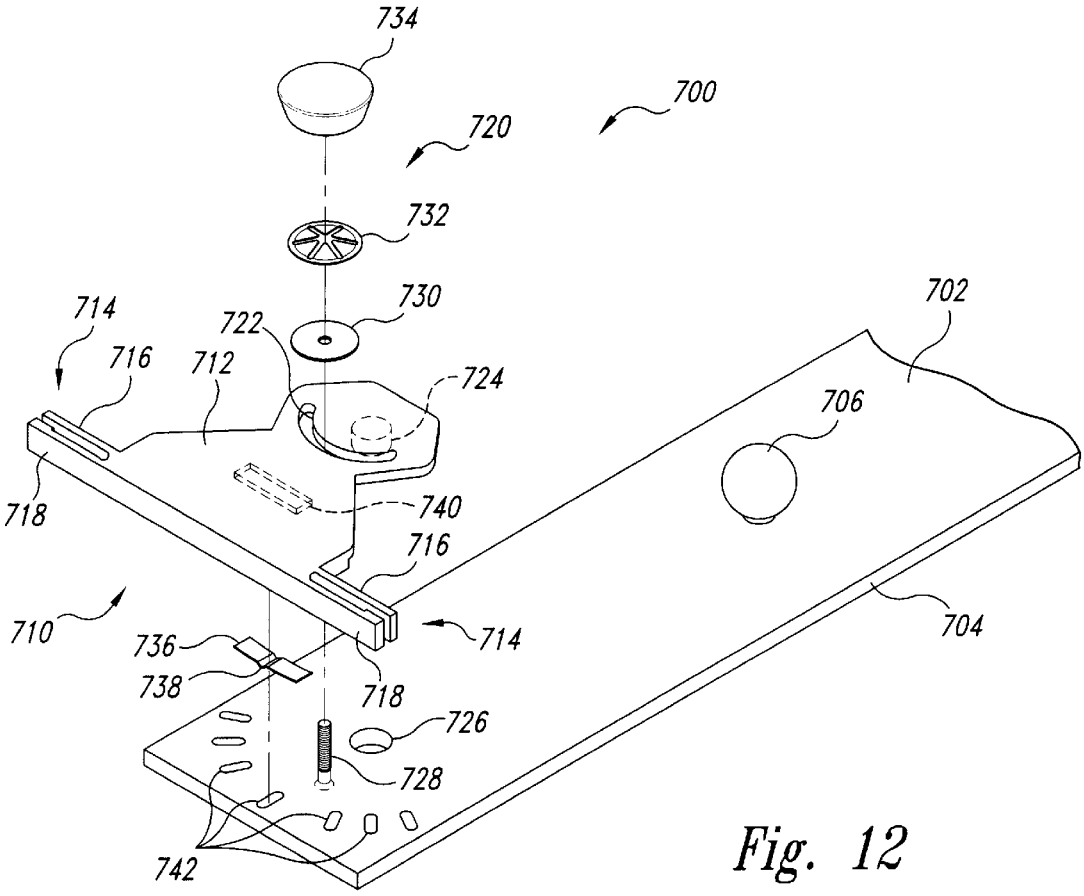
FIG. 12 is an exploded isometric view of an end of a swing arm of FIG. 7.

As best seen in FIG. 12, each pinch clamp 714 includes first and second opposing pinch members 716 and 718, respectively. The first and second pinch members 716 and 718 are engaged against the second channel 610 of the second clamping bar 606, slideably coupling the swing arm 700 with the second clamping bar 606. Alternately, the swing arm 700 may be slideably coupled with the first clamping bar 600 in a similar fashion.

In operation, the second pinch members 718 are resiliently biased against the wall of the second channel 610, firmly pinching the second (or first) clamping bar 606 between the first and second pinch members 716 and 718 to maintain a firm sliding engagement between the end assembly 710 and the second clamping bar 606. Thus, the pinch clamps 714 advantageously maintain a secure, tight fit between the end assembly 710 and the second (or first) clamping bar 606 without the need for expensive, precision tolerance components. The pinch clamps 714 also overcome problems associated with maintaining tight tolerances between components having dissimilar material properties, particularly dissimilar thermal expansion, wear, and surface roughness characteristics. To reduce fabrication costs, the pinch clamps are preferably fabricated from a molded, thermoplastic material.

The end assembly 710 of FIG. 7 also has an angular adjustment assembly 720. As best seen in FIG. 12, the angular adjustment assembly 720 includes an arcuate slot 722 disposed within the chassis 712, and a pivot pin 724 that projects downwardly from the chassis 712 into a pivot hole 724 disposed within the main body 702 of the swing arm 700. A threaded guide pin 728 projects upwardly from the main body 702 and passes through the arcuate slot 722. A flat washer 730 and a tension washer 732 are engaged onto the guide pin 728, and a knob 734 is threadedly engaged with the guide pin 728, thereby securing the chassis 712 to the main body 702. A leaf spring 736 having a ridge 738 is seated within a spring seat 740 in the chassis 712. A plurality of recesses 742 are disposed within the main body 702 for engaging the ridge 738 of the leaf spring 736 at a variety of predetermined angular settings of the main body 702.

In operation, the knob 734 is slightly loosened, thereby loosening the engagement between the ridge 738 and the associated recess 742 of the main body 702. With the end assembly 710 coupled to the first or second clamping bar 600 or 606, the user may grasp and move the handle 706 transversely with respect to a longitudinal axis of the main body 702, thereby causing the main body 702 to rotate about the pivot pin 724 and the guide pin 728 to traverse along the arcuate slot 722. As the main body 702 is rotated, the angle of the straight edge 704 with respect to the clamping bar (first or second) is adjusted to a desired angular position. The user may select one of the predetermined angular positions by engaging the ridge 738 into a selected recess 742, or may position the main body 702 at any other desired angle.

The swing arm 700 having the angular adjustment assembly 720 allows the straight edges 704 to be oriented at any desired position on the base 510. With the swing arm 700 positioned over the flat article to be cut, the main body 702 helps to secure the flat article in place, especially flexible articles such as cloth, and also provides the straight edge 704 for guiding a cutting blade along a desired line of cutting. After a cut has been made, the handle 706 facilitates movement of the swing arm 700 to a new position.

With the swing arm 700 slideably coupled to the first clamp bar 600, and the second clamp bar 606 actuated to the second open position (or vice versa), the main body 702 of the swing arm 700 may be slid under the second clamp bar 606. This allows the straight edge 704 to be positioned over that portion of the base 510 adjacent to the corner actuator assembly 650, at least until the handle 706 contacts the raised second clamp bar 606. It should be noted, however, that the handle 706 may be eliminated from the swing arm 700 so that the movement of the swing arm 700 is not restricted in this manner, and the desired angular positioning of the swing arm may be achieved.

Figure 13A:
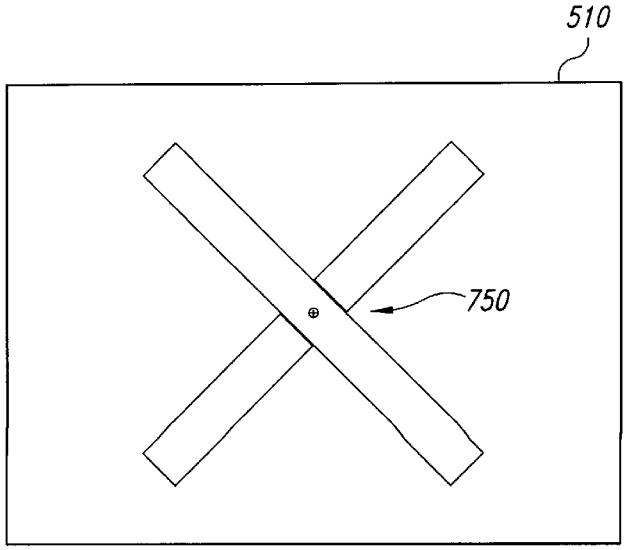
FIG. 13*a* is a bottom elevation view of an embodiment of a base.
Figure 13B:
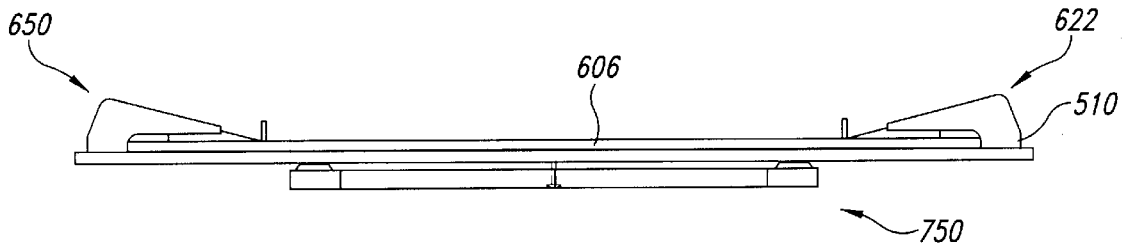
FIG. 13*b* is a side elevation view of the base of FIG. 13*a*.

FIG. 13*a* shows a bottom elevational view of an embodiment of a base 510 having a turntable 750 rotatably attached thereto. A side elevation view of the base 510 having the turntable 750 is shown in FIG. 13*b*. In operation, the turntable 750 is positioned on a surface, such as a table or workbench, and the base 510 may be rotated to any position desired by the user. The turntable 750 may thereby improve the convenience of the device for the user.

Figure 14:
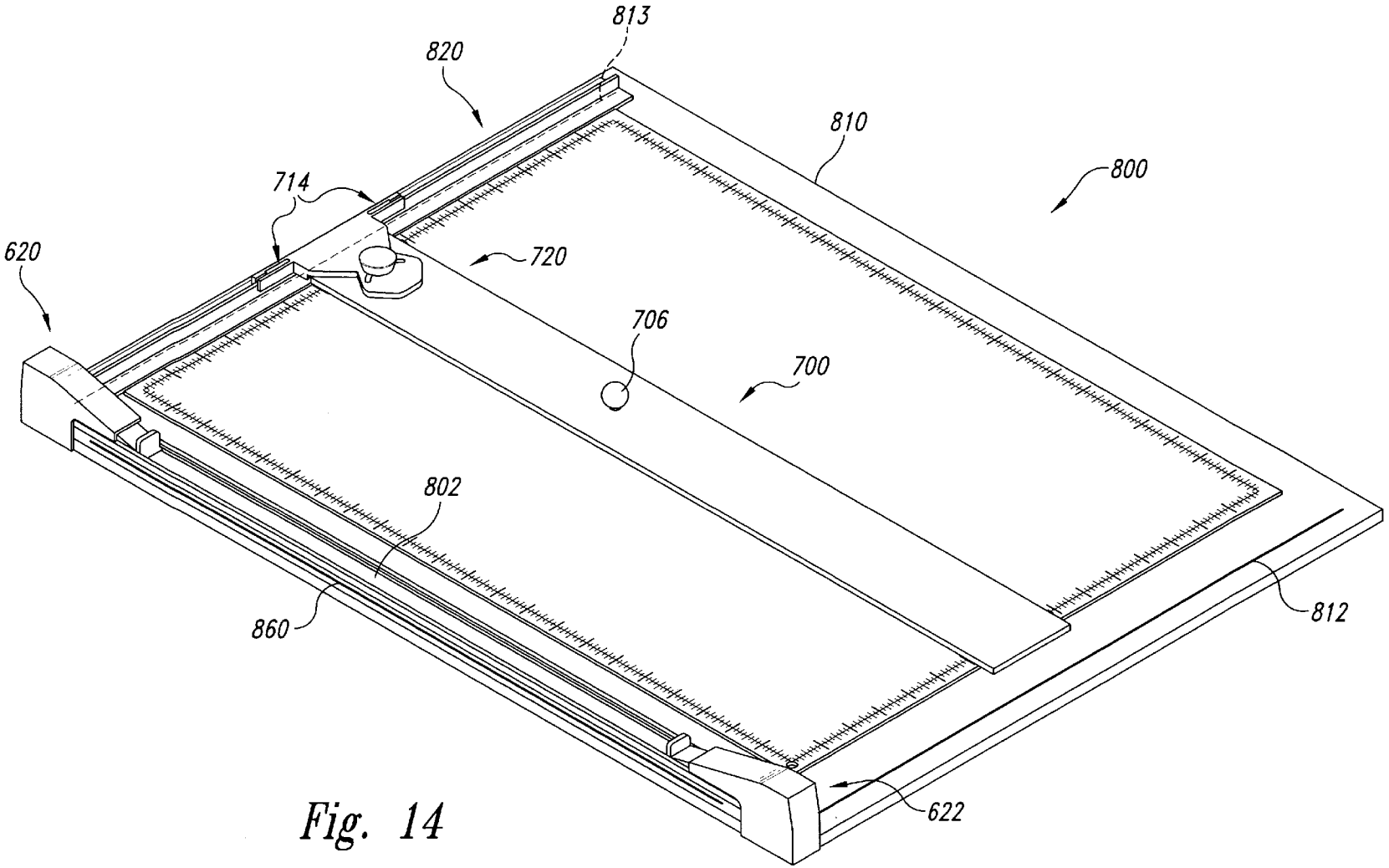
FIG. 14 is an isometric view of yet another alternate embodiment of an apparatus for securing flat articles to be cut.

FIG. 14 shows an isometric view of yet another embodiment of an apparatus for securing flat articles 800. In this embodiment, the apparatus 800 includes a clamp bar 802 secured to a base 810 by a first actuator assembly 620 and a second actuator assembly 622, and a swing arm 700 having a pair of pinch clamps 714 and an angular adjustment assembly 720. The clamp bar 802, the actuator assemblies 620 and 622, and the swing arm 700 all have substantially the same structure and operational characteristics as described and shown above.

Figure 15:
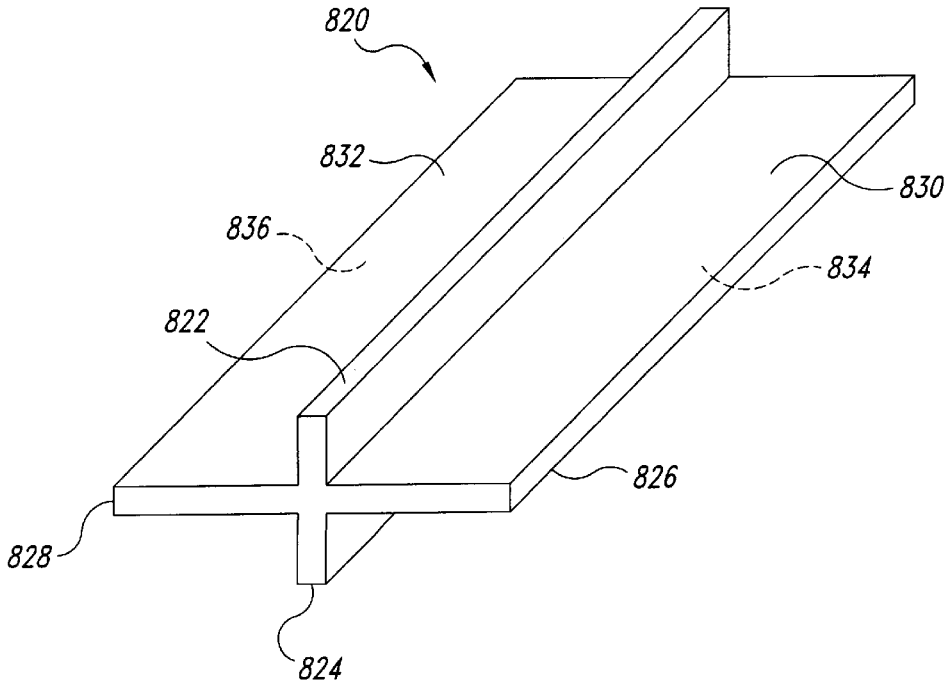
FIG. 15 is an isometric view of the rail member of FIG. 14.

The base 810 of the apparatus 800 has a first channel 812 disposed therein and oriented orthogonally with the clamp bar 802. A rail 820 is disposed within a second channel 813 in the base 810. As shown in FIG. 14, the first and second channels 812 and 813 are preferably substantially parallel and spaced apart at opposite ends of the clamp bar 802. The rail 820 is preferably interchangeably positionable in either the first or second channels. As best seen in FIG. 15, the rail 820 includes a first segment 822 extending upwardly and a second segment 824 extending downwardly. The rail 820 also includes third and fourth segments 826 and 828, respectively, extending horizontally.

In operation, the second segment 824 of the rail 820 is firmly engaged within the second (or first) channel 813. The length and depth of the second channel 813 substantially correspond with the dimensions of the second segment 824. The pinch clamps 714 of the swing arm 700 are then slideably coupled with the first segment 822 of the rail 820. With the rail 820 positioned with the second channel 813, the swing arm 700 may be slid along the first segment 822, allowing the swing arm 700 to be controllably positioned over the base 810.

The second segment 824 of the rail 820 is preferably removable from the second channel 813 and engageable with the first channel 812. This interchangeability allows the rail 820 to be moved between either the first or second channels, and thus the swing arm 700 may be moved to either the left or right sides of the base 810 as may be preferred by a particular user.

Furthermore, as shown in FIG. 15, the second segment 826 of the rail 820 includes upper and lower surfaces 830 and 834, and the fourth segment 828 includes upper and lower surfaces 832 and 836, respectively. With the rail 820 positioned in the second channel 813 as shown in FIG. 14, the third segment 826 of the rail 820 extends inwardly toward the first channel 812. Although the rail 820 may be fabricated from a wide variety of materials, it is preferably fabricated of a material that permits the user to make markings along the upper surface 830 of the third segment 826 to facilitate the cutting process, particularly for those applications which require the repeated cutting of flat articles of consistent dimensions, such as in the art of quilting.

It is also preferable that the rail 820 is rotatable such that the second segment 824 may be firmly engaged into the second channel 813 with the fourth segment 828 extending inwardly toward the first channel 812. This feature advantageously allows the user to make another set of markings along the upper surface 832 of the fourth segment 828 (see FIG. 15) to further facilitate the cutting process.

Finally, it is also preferable that the rail 820 is invertible so that the first segment 822 of the rail 820 is firmly engageable with the second (or first) channel 813, and the second segment 824 is slideably coupleable with the pinch clamps 714 of the swing arm 700. This preferred invertibility allows either the lower surfaces 834 and 836 of the third and fourth segments 826 and 828, respectively, to be positioned facing upwardly and inwardly so that the user may make additional sets of markings on these surfaces. Thus, in a preferred embodiment, the rail 820 provides four surfaces upon which the user may make markings to facilitate the measuring and cutting of flat articles.

The apparatus 800 may include one or more additional channels for firmly securing the rail 820 to the base 810.

Also, the apparatus may include one or more additional rail members, and alternate embodiments of the rail member may have a different cross-sectional shape from the rail 820 shown in FIG. 15. Alternate rail members need not be interchangeable between channels, but rather may be constructed such that each rail will only fit within a particular channel. Furthermore, the rails need not be removable from the base 810.

An advantage of the apparatus 800 having the first channel 812 and the rail 820 is that the range of coverage of the swing arm 700 over the base 810 is improved. When the swing arm 700 is slideably coupleable with the rail 820, the swing arm 700 is better able to reach the corner areas of the base that are distant from the clamp bar 802. The range of motion of the swing arm 700 is maximized because the swing arm 700 does not encounter an actuator assembly at the end of the rail 820 that is distant from the clamp bar 802.

Also, with the swing arm 700 slideably coupled with the clamp bar 802, the rail 820 is preferably removable so that the swing arm 700 may be easily moved into the corner areas of the base 810 that are near to the clamp bar 802. Because there are no additional clamp bars attached to the base 810, the handle 706 of the swing arm 700 does not hit an adjacent clamp bar when the swing arm 700 is moved into the corner areas of the base 810 near the clamp bar 802. Thus, improved coverage of the base by the swing arm 700 in the areas near the clamp bar 802 is achieved.

Furthermore, the apparatus 800 having a single clamp bar and rail member is easier and less expensive to manufacture. The corner actuator assembly 650 and second clamp bar 606 (see FIG. 7) are eliminated, and the second clamp bar is replaced with a simple channel and rail combination. Fabrication and assembly costs are thereby reduced, and the apparatus 800 is more easy to maintain by the user.

Figure 16:
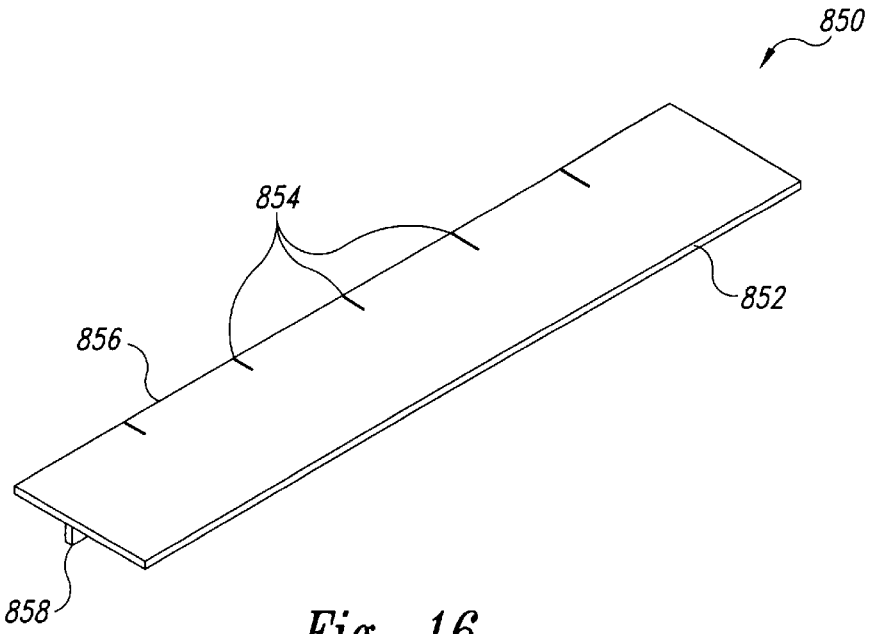
FIG. 16 is an isometric view of an alternate embodiment of a sizing gauge.

FIG. 16 shows an embodiment of a sizing gauge 850 that can be utilized with the apparatus 800 (or other embodiments of the invention). The sizing gauge 850 includes an elongated plate 852 having a leading edge 856, and a rib 858 projecting downwardly therefrom and extending longitudinally along the length of the plate 852. Like the rail 820 described above, the sizing gauge 850 is preferably fabricated of a material that permits the user to make markings 854 along the leading edge 856 to facilitate measuring and cutting, particularly for those applications which require the repeated cutting of flat articles of consistent dimensions. As shown in FIG. 14, the base 810 includes a third channel 860 that is disposed beneath the clamp bar 802.

In operation, the clamping bar 802 is positioned in the open position and the rib 858 is slideably engaged within the third channel 860. The sizing gauge 850 is slideably positionable along the length of the third channel 860, and the clamp bar 802 is moved to the clamping position against the plate 852 of the sizing gauge 850, thereby securing the flat article to the base 810 for cutting. A flat article to be cut is positioned on the base 810, and the swing arm 700 is slideably coupled with the clamp bar 802. The straight edge 704 of the swing arm 700 is aligned with the desired markings 854 on the sizing gauge 850, and the flat article is cut by sliding a cutting tool along the straight edge 704.

Preferably, the rib 858 of the sizing gauge 850 may also be slideably engaged within the first and second channels 812 and 813, allowing the sizing gauge 850 to be slideably positioned at a wide variety of locations on the base 810. Alternately, the rib 858 may be flipped over or eliminated, allowing the sizing gauge 850 to be utilized by itself as a straight edge on any base, including those without channels. Finally, when the sizing gauge 850 is used with a cutting mat positioned on the base, the thickness of the plate 852 of the sizing gauge 850 is preferably equal to the thickness of the cutting mat, allowing a flat article to be inserted smoothly and easily under the clamp bar without interference from the leading edge 856 of the sizing gauge 850 or an edge of the cutting mat.

Figure 17:
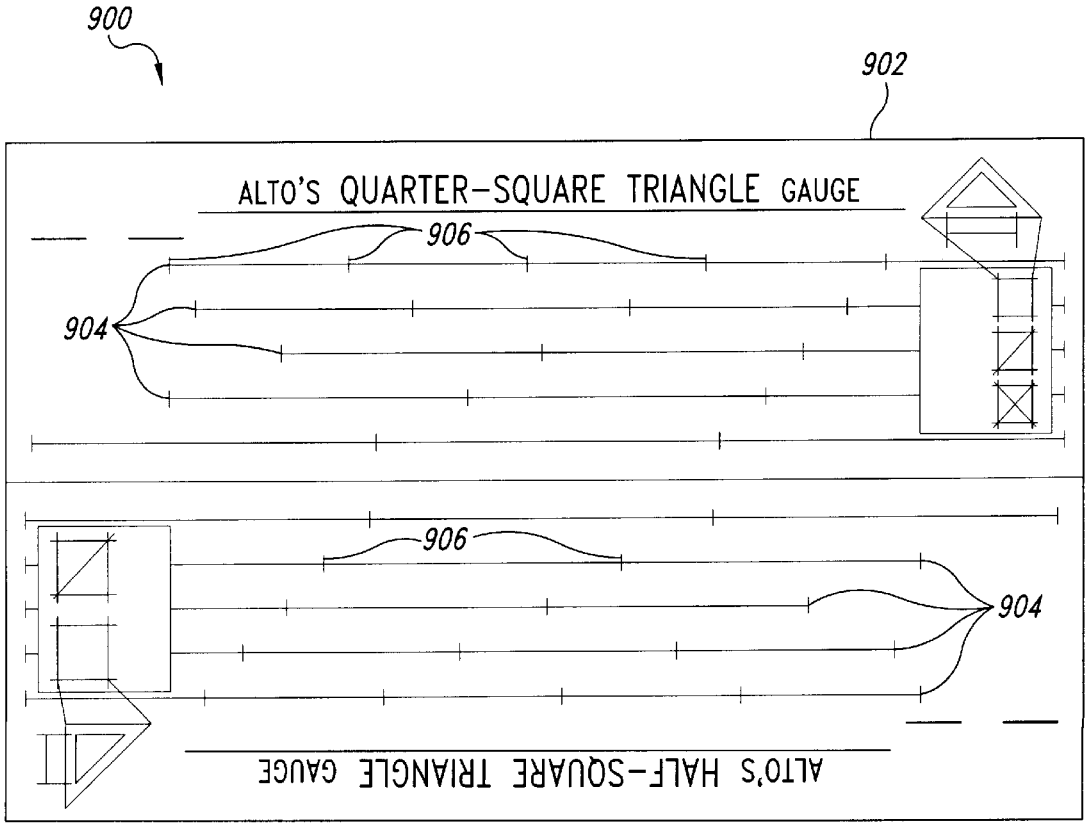
FIG. 17 is a front elevation view of an embodiment of a measuring template.

FIG. 17 shows an embodiment of a measuring template 900 that also can be utilized with the apparatus 800 (or other embodiments of the invention). The measuring template 900 includes a substantially flat base 902 having a plurality of measuring guides 904 thereon. Each measuring guide 904 has a plurality of transverse measuring marks 906 therealong. The measuring marks 906 are spaced apart a constant, predetermined distance that is different for each measuring guide 904.

In operation, the measuring template 900 is used to mark the rail 820 or the sizing gauge 850 to align the swing arm 700 at a plurality of cutting positions. The user aligns an edge of the rail 820 or the sizing gauge 850 with the desired measuring guide 904 of the measuring template 900, and marks the rail 820 or the sizing gauge 850 at locations corresponding to the measuring marks 906. The rail 820 or the sizing gauge 850 is then positioned on the base in a channel, and the swing arm is successively aligned with the marks on the rail 820 or the sizing gauge 850 for making cuts therealong. The measuring template 900 is particularly useful for those applications which require the repeated cutting of flat articles of consistent dimensions, such as in the art of quilting.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with the above-referenced patents, herein incorporated by reference, to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other apparatus for securing flat articles to be cut, not necessarily the exemplary flat article securing apparatus described above and shown in the figures. In general, in the following claims, the terms used should not be construed to limit the invention to the specific embodiments disclosed in the specification and the claims, but should be construed to include all flat article securing apparatus that operate under the claims to secure flat articles for cutting. Accordingly, the invention is not limited by the foregoing disclosure, but instead its scope is to be determined by the following claims.

What is claimed is:

1. An apparatus for securing flat articles to be cut, comprising:

a base for receiving flat articles to be cut, the base having a first channel disposed therein;

a clamp bar moveable between a clamping position near the base and an open position away from the base;

at least one actuator coupled to the base and operatively engaging the clamp bar and being slideably moveable between a first position to actuate the clamp bar to the clamping position, and a second position to actuate the clamp bar to the open position;

a rail member having a first segment positioned in the first channel and a second segment projecting away from the base; and an elongated swing arm having a straightedge and an end slideably coupled with one of the second segment and the clamp bar, the swing arm being slideably positionable on the base.

2. The apparatus of claim 1 wherein the rail member further includes a third segment and a fourth segment, the first, second, third, and fourth segments forming a substantially cross-shaped cross section.

3. The apparatus of claim 1 wherein the clamp bar is positioned at a substantially right angle to the first channel.

4. The apparatus of claim 1 wherein the base further includes a second channel spaced apart from the first channel, the rail member being interchangeably positionable in the first and second channels.

5. The apparatus of claim 1 wherein the base further includes a second channel spaced apart from and substantially parallel to the first channel, the rail member being interchangeably positionable in the first and second channels.

6. The apparatus of claim 1 wherein the base further includes a second channel substantially parallel to the clamp bar, and wherein the apparatus further comprises a sizing gauge having an elongated, substantially flat main member and a rib projecting therefrom along a longitudinal axis of the main member, the rib being positionable in the second channel.

7. The apparatus of claim 1 wherein the end of the swing arm includes a pinch clamp slideably coupled with one of the second segment and the clamp bar, the swing arm being slideably positionable on the base.

8. The apparatus of claim 1 wherein the end of the swing arm includes an angular adjustment assembly slideably coupled with one of the second segment and the clamp bar, the swing arm being pivotally and slideably positionable on the base.

9. The apparatus of claim 1 wherein the at least one actuator comprises a slide member having an elongated slot, and a retaining post, the retaining post projecting from the base and into the elongated slot, the slide member slideably engageable with the clamp bar and shaped to actuate the clamp bar into the clamping position when the slide member is in the first position, and to actuate the clamp bar into the open position when the slide member is in the second position.

10. The apparatus of claim 9 wherein the slide member includes a retaining slot disposed therein and the retaining post includes a retaining pin that slideably engages the retaining slot.

11. The apparatus of claim 1 wherein the end of the swing arm is coupled to an angular adjustment assembly, the angular adjustment assembly comprising:

a substantially flat body having an arcuate slot disposed therein and a pivot pin projecting therefrom, the pivot pin pivotally engaging a pivot hole disposed in the swing arm substantially near the end thereof, the swing arm having a guide pin projecting through the arcuate slot and threadedly engaging a knob that secures the body to the swing arm at a desired angular position, the body further including a pinch clamp slideably coupled with one of the clamp bar the second segment, the swing arm being slideably and pivotably positionable on the base.

12. An apparatus for securing flat articles to be cut, comprising:

a base for receiving flat articles to be cut;

a clamp bar moveable between a clamping position near the base and an open position away from the base;

at least one actuator coupled to the base and operatively engaging the clamp bar and being slideably moveable between a first position to actuate the clamp bar to the clamping position, and a second position to actuate the clamp bar to the open position;

an elongated member extending lengthwise along the base and projecting away from the base; and an elongated swing arm having a straightedge and an end moveably coupled with one of the elongated member and the clamp bar, the swing arm being moveably positionable on the base.

13. The apparatus of claim 12 wherein the clamp bar is positioned at a substantially right angle to the elongated member.

14. The apparatus of claim 12 wherein the elongated member is interchangeably positionable on the base at two spaced apart locations.

15. The apparatus of claim 12 wherein the elongated member is interchangeably positionable on the base at two spaced apart locations, the orientations of the elongated member at the two spaced apart locations being substantially parallel.

16. The apparatus of claim 12 wherein the elongated swing arm is configured to be interchangeably, moveably coupled with the elongated member and the clamp bar.

17. The apparatus of claim 12 wherein the apparatus further comprises a sizing gauge having an elongated, substantially flat member positionable substantially parallel to the clamp bar.

18. The apparatus of claim 12 wherein the end of the swing arm includes a pinch clamp moveably coupled with one of the elongated member and the clamp bar, the swing arm being moveably positionable on the base.

19. The apparatus of claim 12 wherein the end of the swing arm includes an angular adjustment assembly moveably coupled with one of the elongated member and the clamp bar, the swing arm being pivotally and moveably positionable on the base.

20. The apparatus of claim 12 wherein the at least one actuator comprises a slide member having an elongated slot, and a retaining member projecting from the base and into the elongated slot, the slide member slideably engageable with the clamp bar and shaped to actuate the clamp bar into the clamping position when the slide member is in the first position, and to actuate the clamp bar into the open position when the slide member is in the second position.

21. The apparatus of claim 20 wherein the slide member includes a retaining slot disposed therein and the retaining member includes a retaining arm that slideably engages the retaining slot.

22. The apparatus of claim 12 wherein the end of the swing arm is coupled to an angular adjustment assembly comprising:

a substantially flat body having an arcuate slot disposed therein and a pivot pin projecting therefrom, the pivot pin pivotally engaging a pivot hole disposed in the swing arm substantially near the end thereof, the swing arm having a guide pin projecting through the arcuate slot and threadedly engaging a knob that secures the body to the swing arm at a desired angular position, the body further including a pinch clamp slideably coupled with one of the clamp bar and the second segment, the swing arm being slideably and pivotably positionable on the base.

* * * * *

UNITED STATES PATENT AND TRADEMARK OFFICE

CERTIFICATE OF CORRECTION

PATENT NO. : 6,182,549 B1
DATED : February 6, 2001
INVENTOR(S) : Alto Albright and Sam Albright It is certified that error appears in the above-identified patent and that said Letters Patent is hereby corrected as shown below:

Claim 11, column 15,
Line 58, "clamp bar the second" should read -- claim bar and the second --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,182,549 B1
DATED : February 6, 2001
INVENTOR(S) : Alto Albright et al.

It is certified that error appears in the above-identified patent and that said Letters Patent is hereby corrected as shown below:

Column 15, claim 11,
Line 58, "claim bar and the second" should read -- clamp bar and the second --.

Signed and Sealed this

Fifth Day of March, 2002

*Attest:*

*Attesting Officer*

JAMES E. ROGAN
*Director of the United States Patent and Trademark Office*